US006887099B1

(12) United States Patent
Tung

(10) Patent No.: US 6,887,099 B1
(45) Date of Patent: May 3, 2005

(54) MULTI-LAYER CONNECTOR

(76) Inventor: Meng Tung, P.O. Box No. 6-57, Junghe, Taipei 235 (TW)

( * ) Notice: Subject to any disclaimer, the term of this patent is extended or adjusted under 35 U.S.C. 154(b) by 0 days.

(21) Appl. No.: 10/724,698

(22) Filed: Dec. 2, 2003

(51) Int. Cl.[7] ..... H01R 13/60
(52) U.S. Cl. ..... 439/541.5
(58) Field of Search ..... 439/541.5, 607, 439/79, 80

(56) References Cited

U.S. PATENT DOCUMENTS 6,234,833 B1 * 5/2001 Tsai et al. ..... 439/541.5
6,290,535 B1 * 9/2001 Lin et al. ..... 439/541.5
2003/0211776 A1 * 11/2003 Lin ..... 439/541.5

* cited by examiner

*Primary Examiner*—J. F. Duverne
*Assistant Examiner*—Phuong Dinh

(57) ABSTRACT

A multi-layer connector includes a plastic housing, terminals and a metal housing. The plastic housing is consisted of a plastic body and a terminal support, wherein the plastic body is provided with five integrated analog signal connecting openings at a front side thereof. To assemble the structure, the terminal main bodies are inserted into the terminal support, and the terminal front ends are placed into the sliding channels of the plastic body and are positioned by positioning pins at a lower portion of the plastic body and the terminal support. The aforesaid assembled structure is then covered by the metal housing, thereby offering a facilitated assembly as well as economized part and manufacturing costs.

4 Claims, 6 Drawing Sheets

MULTI-LAYER CONNECTOR

BACKGROUND OF THE INVENTION (a) Field of the Invention

The invention relates to a multi-layer connector, and more particularly, to a multi-layer connector for transmitting computer video and audio data and comprising a plastic housing, terminals and a metal housing. Wherein, the plastic housing is consisted of a plastic body and a terminal support.

(b) Description of the Prior Art

Referring to FIG. 1 showing a prior signal connector installed to a computer equipment and for inputting and outputting analog audio data, because current computer equipments are generally provided with five-track functions including signal data input, microphone signal input, front speaker output, rear speaker output, and center and bass speaker output, a quantity of signal connectors required is also increased. The signal connectors are mostly arranged in stacks or arranged side by side. However, when the aforesaid signal connectors are simultaneously installed at a same circuit board, a large area is inevitably occupied as a shortcoming. Furthermore, it is necessary that parts of the signal connectors be individually manufactured, and duplications are also resulted to lead to wastage. Supposed the connectors are piled and covered with metal housings, and altogether adhered to pins of a circuit board, a huge amount of housings having different shapes are needed, meaning that different molds need to be provided in advance as well. Consequently, time is wasted and production costs are elevated without conforming to market practicability and economical concerns. It is crucial that the aforesaid structure be advanced.

SUMMARY OF THE INVENTION

An object of the invention is to provide a multi-layer connector for overcoming the aforesaid shortcomings while also offering facilitated assembly and economized part and manufacturing costs.

To accomplish the above object, a multi-layer connector according to the invention comprises a plastic housing, terminals and a metal housing. The plastic housing is consisted of a plastic body and a terminal support. A front side of the plastic body is excavated with five analog signal connecting openings having identical dimensions. The analog signal connecting openings are for accommodating signal connecting nuts therein. A rear side of the plastic body is provided with sliding channels for placing and positioning terminal front ends. An upper portion of the plastic body is disposed with a fastening mechanism for joining with the terminal support. An interior of the terminal support is divided into various compartments for accommodating various terminal main bodies. The terminal support is excavated with terminal openings at a lower portion thereof, and is provided with a fastening mechanism at an upper rear portion thereof for coordinating with the fastening mechanism of the plastic body. The terminal support also has positioning pins at a lower portion thereof for positioning the entire assembled structure to a circuit board.

According to the aforesaid descriptions, to assemble the structure, the terminal main bodies are inserted into the terminal support, and the terminal front ends are inserted into the sliding channels of the plastic body. The signal nuts having different colors but identical dimensions are placed in the signal connecting openings at the front end of the plastic body, so as to substantially reduce mold and material costs. When the positioning pins at the lower portion of the plastic body are placed into the positioning openings at the lower portion of the terminal support, the fastening mechanisms of the terminal support and the plastic body are wedged and fastened with each other. The entire aforesaid structure is covered and fixed by the metal housing, and then altogether stabilized to pins of the circuit board for minimizing assembly time.

DETAILED DESCRIPTION OF THE PREFERRED EMBODIMENTS

To better understand the structures, devices and characteristic of the invention, detailed descriptions of a preferred embodiment shall be given with the accompanying drawings below.

Figure 1:
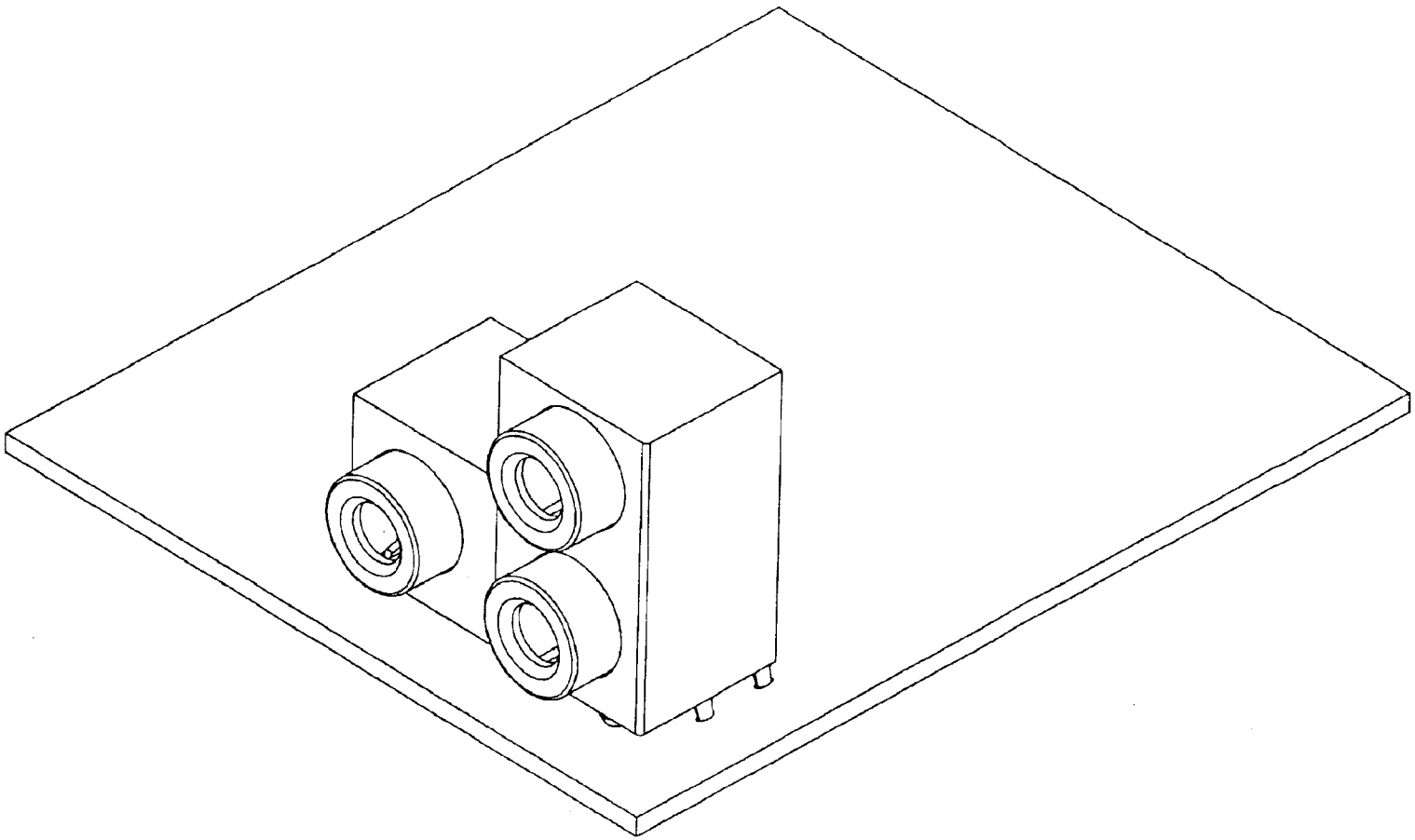
FIG.1 Prior Art
FIG. 1 shows an elevational view of a prior art.
Figure 2:
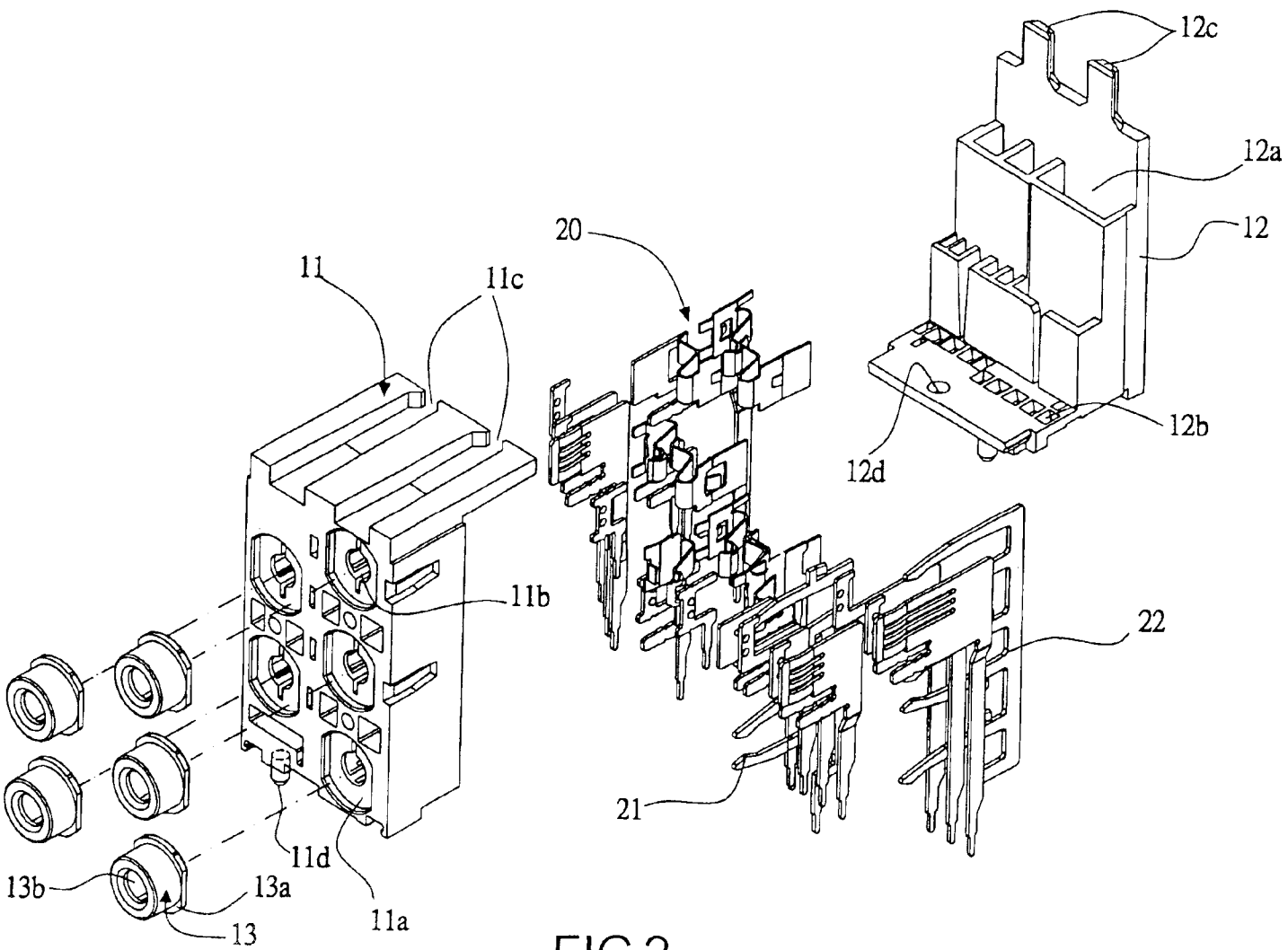
FIG. 2 shows an exploded view of a plastic body and a terminal support according to the invention.
Figure 3:
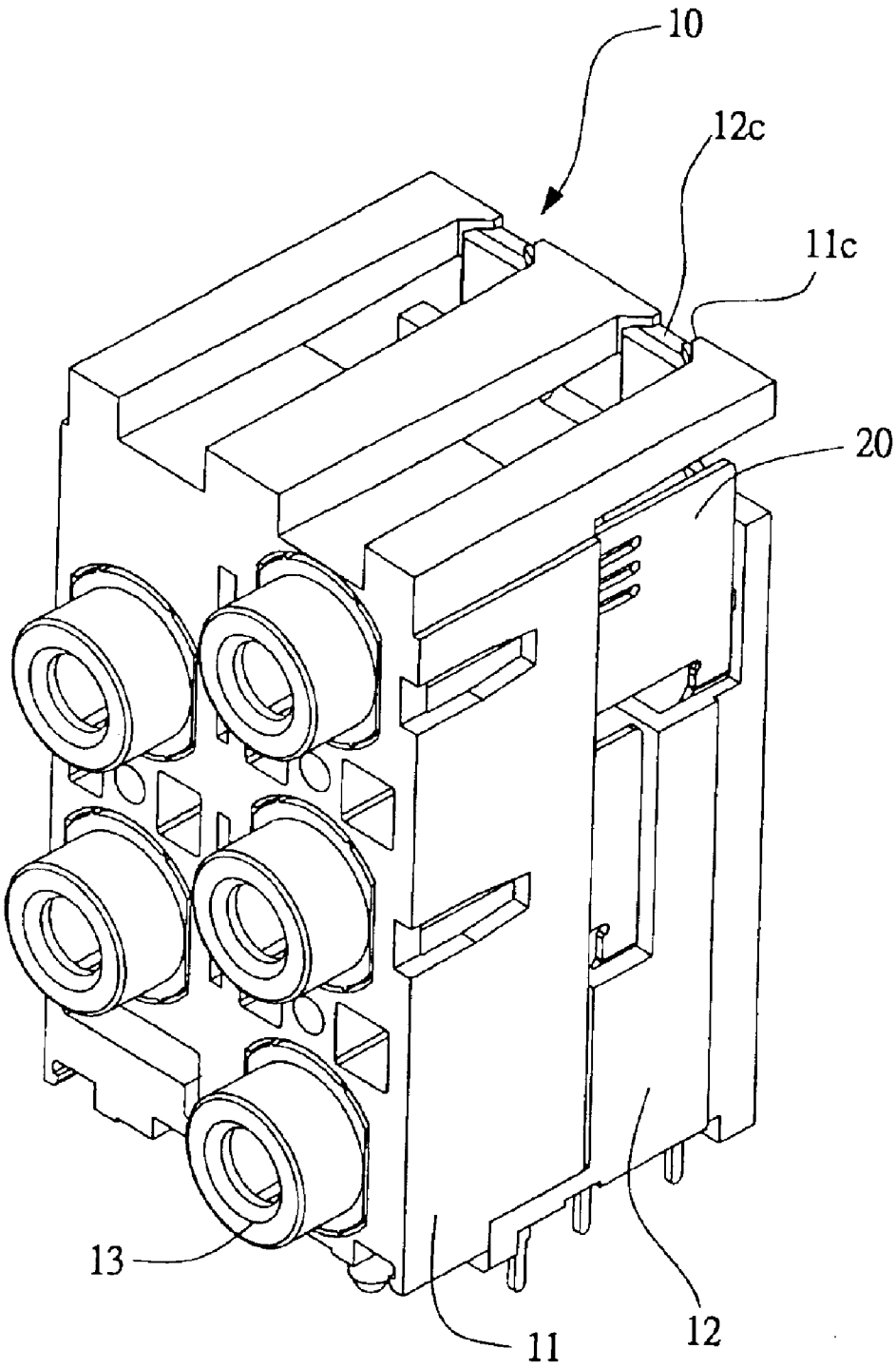
FIG. 3 shows an assembled structural view of a plastic body and a terminal support according to the invention.
Figure 4:
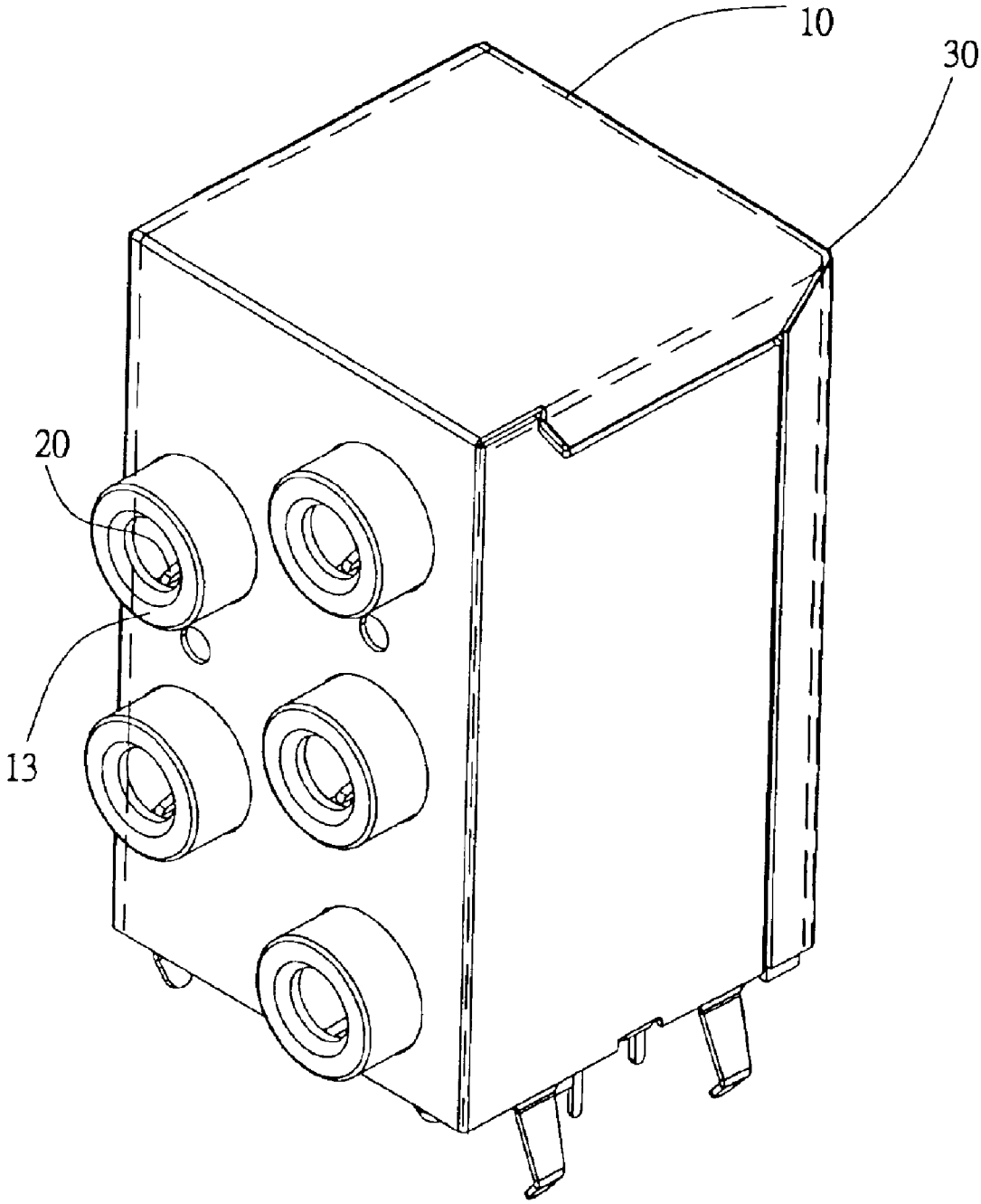
FIG. 4 shows an elevational view according to the invention.
Figure 5:
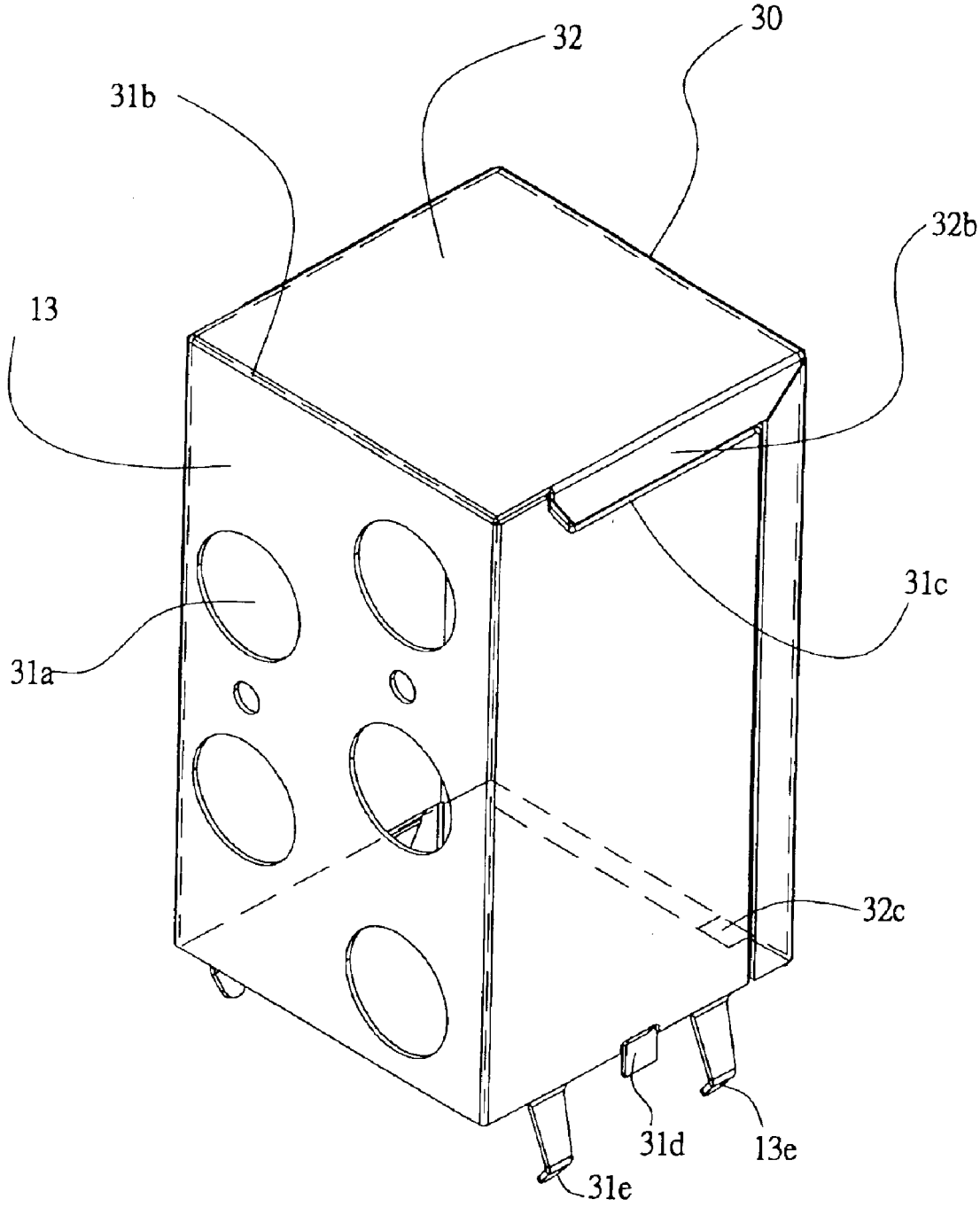
FIG. 5 shows an elevational view of a metal housing according to the invention.
Figure 6:
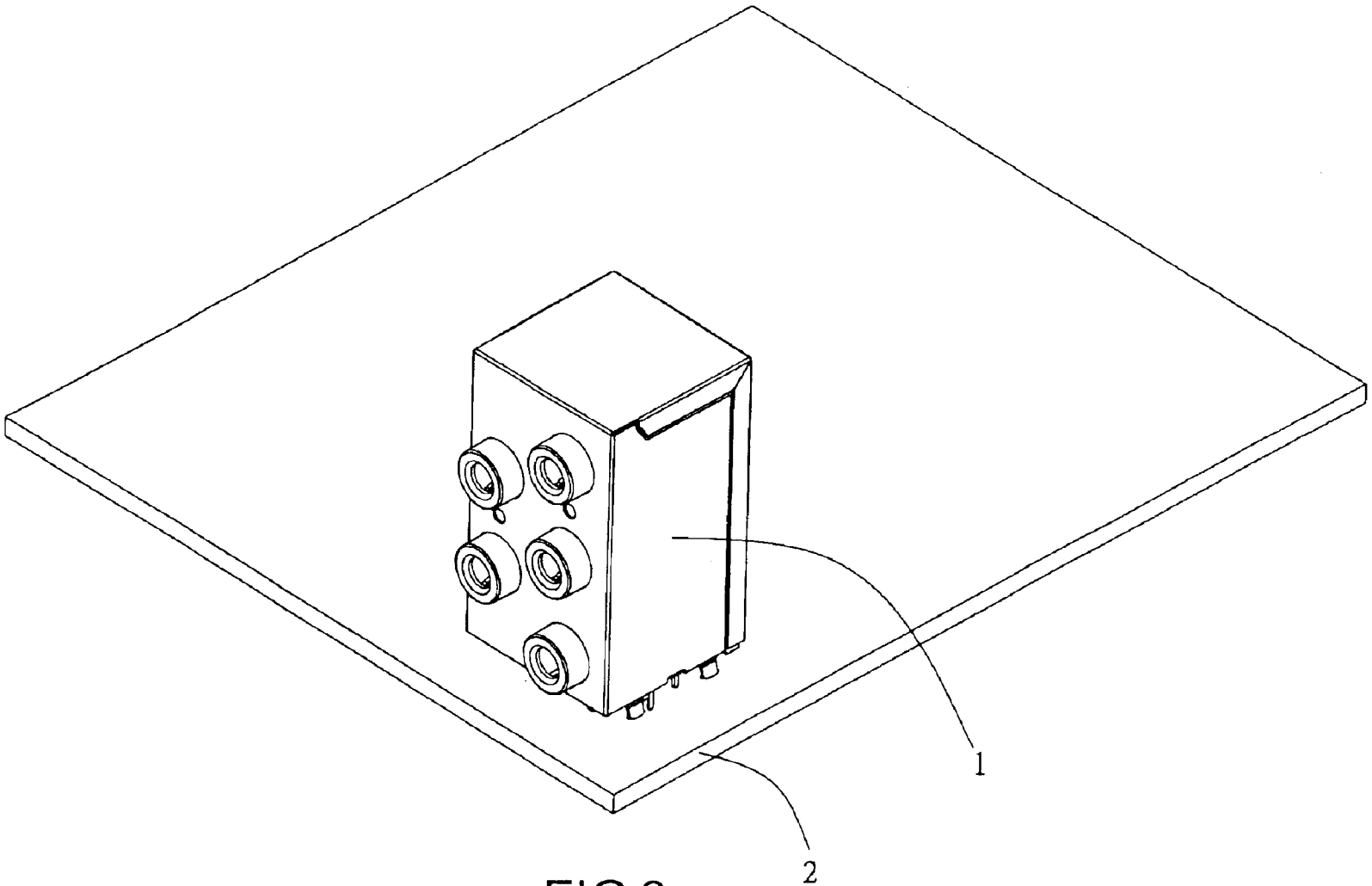
FIG. 6 shows a schematic view according to the invention in use.

Referring to FIGS. 2, 3 and 4, a multi-layer connector 1 according to the invention comprises a plastic housing 10, terminals 20 and a metal housing 30. The plastic housing 10 is consisted of a plastic body 11 and a terminal support 12. Wherein, a front side of the plastic body 11 is disposed with five analog signal connecting openings 11*a* having identical dimensions. The analog signal connecting openings 1*a* have dimensions corresponding to those of signal connecting nuts 13, so as to accommodate the signal connecting nuts 13 therein. Each of the signal connecting nuts 13 is a hollow hat-shaped body, and has a skirt portion 13*a* at a periphery thereof and a round hole 13*b* at a center thereof for inserting signal terminals. A rear side of the plastic body 11 is provided with sliding channels 11 for placing and positioning terminal front ends 21. An upper portion of the plastic body 11 is disposed with a fastening mechanism 11*c* for joining with the terminal support 12. An interior of the terminal support 12 is divided into various compartments 12*a* for accommodating various terminal main bodies 22. The terminal support 12 is excavated with terminal openings 12*b* at a lower portion thereof, and is provided with a fastening mechanism 12*c* at an upper rear portion thereof for coordinating with the fastening mechanism 11*c* of the plastic body 11. A fastening mechanism 11*c* of the plastic body 11 is a clamp-shaped structure. A fastening mechanism 12*c* of the terminal support 12 has a shape corresponding to that of a front end of the fastening mechanism 11*c*, and appears as a shape having a protruding edge. The fastening mechanism 12*c* is inserted into a gap at a front end via a lower portion of the fastening mechanism 11*c* of the plastic body 11. To assemble the invention, the terminal main bodies 22 are inserted into the terminal support 12, and the terminal front ends 21 are placed into the sliding channels of the plastic body 11. Positioning pins 11*d* at a lower portion of the plastic body 11 are placed into positioning holes 12*d* at a lower portion of the terminal support 12, and the fastening mechanisms 11*c* and 12*c* of the terminal support 12 and the plastic body 11 are wedged and fastened with each other. The entire aforesaid structure is covered using the metal housing 30 and then fastened. Referring to FIG. 5, the metal housing 30 is formed by bending and stamping a thin metal plate. A front panel 31 of the metal housing 30 is provided with five openings 31*a* having shapes and dimensions corresponding to the signals connecting nuts 13 and a folded line 31*b* at an upper portion thereof for connecting with an upper panel 32, bent at two sides thereof for forming a U shape, and reserved with recesses 31*c* at edges thereof. The front panel 31 further has a bending plate 31*d* and a fixing plate 31*e* at two lower edges thereof, respectively. Wherein, the bending plates 31*d* are for clamping and fixing the plastic housing 10, and the fixing plates 31*e* are for stabilizing the entire connector 1 at a circuit board 2. The upper panel 32 is provided with cover plates 32*a* bent in a downward direction for corresponding with the recesses 31*c* at the edges of the front panel 31, and folded with a folding line 32*b* at an appropriate position thereof so as to fold the upper panel 32 into an L shape. The upper panel 32 further has folding plates 32*c* at upper edges thereof for clamping and fixing the plastic housing 10. FIG. 6 shows an embodiment of the entire connector 1 being disposed at the circuit board 2.

Conclusive from the above, the multi-layer connector according to the invention utilizes nuts having identical shapes and dimensions, and an assembly of a plastic housing and a terminal support to decrease mold expenses for manufacturing, with the common parts further economizing material costs. It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A multi-layer connector comprising a plastic housing, terminals and a metal housing; wherein, the plastic housing is consisted of a plastic body and a terminal support; wherein, a front side of the plastic body is disposed with five analog connecting openings having identical dimensions corresponding with those of signal connecting nuts, a rear side of the plastic body is disposed with sliding channels, an upper portion of the plastic housing is provided with a fastening mechanism for joining with the terminal support, an interior of the terminal support is divided into various compartments, a lower portion of the terminal support is disposed with terminal openings for penetrating through terminal pins, and an upper rear portion of the terminal support is formed with a fastening mechanism for corresponding with the fastening mechanism of the plastic body; the plurality of terminals is inserted into appropriate positions within the plastic housing, with front ends thereof inserted and located into the sliding channels and main bodies thereof placed into different compartments divided in the terminal support;

the metal housing is for covering the aforesaid assembled structure, and has openings for penetrating the signal connecting nuts to an exterior; and to assemble the aforesaid structure, the terminal main bodies are inserted into the terminal support, the terminal front ends are inserted into the sliding channels in the plastic body, positioning pins at the lower portion of the plastic body are inserted into positioning openings at the lower portion of the terminal the fastening mechanisms of the terminal support and the plastic body are wedged and fastened with each other, and the assembled structure is covered and fixed using the metal housing.

2. The multi-layer connector in accordance with claim 1, wherein each signal connecting nut is a hollow hat-shaped body having a skirt portion at a periphery thereof, and a round orifice at a center portion thereof for inserting signal terminals.

3. The multi-layer connector in accordance with claim 1, wherein:

the metal housing is formed by bending and stamping a thin metal plate; a front panel thereof has five openings with sizes and dimensions corresponding to those of the signal connecting nuts; an upper portion of the front panel is provided with a folding line for joining with an upper panel; the front panel is bent at two sides thereof for forming a U shape, and is reserved with recesses al edges thereof; the front panel further has a bending plate and a fixing plate at two lower edges thereof, respectively; the bending plates are for clamping and fixing the plastic housing, and the fixing plates are for stabilizing the entire connector at a circuit board; the upper panel is provided with cover plates bent in a downward direction for corresponding with the recesses at the edges of the front panel, and folded with a folding line at an appropriate position thereof so as to fold the upper panel into an L shape; and the upper panel farther has folding plates at upper edges thereof for clamping and fixing the plastic housing.

4. The multi-layer connector in accordance with claim 1, wherein the fastening mechanism of the terminal support has a shape corresponding to that of a front end of the fastening mechanism, and appears as a shape having a protruding edge; and the fastening mechanism is inserted into a gap at a front end via a lower portion of the fastening mechanism of the plastic body.

* * * * *